United States Patent [19]

Kohler

[11] Patent Number: 5,067,185

[45] Date of Patent: Nov. 26, 1991

[54] TOILET BOWL PROTECTOR

[76] Inventor: Frederick H. Kohler, 13527 98th Avenue, Surrey, British Columbia, Canada, V3T 1B9

[21] Appl. No.: 540,574

[22] Filed: Jun. 19, 1990

[51] Int. Cl.[5] ..... A47K 13/00

[52] U.S. Cl. ..... 4/661; 4/243; 4/DIG. 18

[58] Field of Search ..... 4/242, 243, 252 A, 300.3, 4/420, DIG. 18, 580, 661

[56] References Cited

U.S. PATENT DOCUMENTS

| | | | |
|---|---|---|---|
| 1,124,103 | 1/1915 | Bluff | 4/243 |
| 1,221,661 | 4/1917 | Bloch | 4/243 |
| 1,641,029 | 8/1927 | Gaudet . | |
| 2,658,201 | 11/1953 | Sherwood . | |
| 2,817,851 | 12/1957 | Barnwell | 4/DIG. 18 X |
| 2,825,070 | 3/1958 | Alexander et al. . | |
| 3,524,203 | 8/1970 | Ruggles . | |
| 3,914,803 | 10/1975 | Gregovski . | |
| 4,160,295 | 7/1979 | Putyra . | |
| 4,165,545 | 8/1979 | Stoltzfus | 4/252 A |
| 4,285,075 | 8/1981 | Nelson . | |
| 4,720,880 | 1/1988 | Barreau . | |

FOREIGN PATENT DOCUMENTS

| | | | |
|---|---|---|---|
| 2714586 | 10/1978 | Fed. Rep. of Germany | 4/242 |

*Primary Examiner*—Charles E. Phillips

*Attorney, Agent, or Firm*—Kolisch, Hartwell, Dickinson, McCormack & Heuser

[57] ABSTRACT

This invention relates to a novel toilet bowl protector which fits as a skirt around a toilet bowl. A removable toilet bowl protector comprising: (a) a flexible waterproof sheet which is adapted to cover the exterior surfaces of a toilet bowl and which has a hole in the central area thereof, the periphery around the hole being adapted to fit about the upper rim of a toilet bowl; and (b) attachment means for enabling the periphery around the hole to be releasably attached to the upper rim of the toilet bowl.

7 Claims, 2 Drawing Sheets

TOILET BOWL PROTECTOR

FIELD OF THE INVENTION

This invention relates to a novel toilet bowl protector or decorator which fits as a skirt around a toilet bowl.

BACKGROUND OF THE INVENTION

The problem of urine accumulating on the exterior of a toilet bowl has been long standing. A typical male urinates into a toilet bowl from a standing position and as a consequence, through incidental spray, some of the urine is deposited around the rim of the toilet bowl. Some of the accumulated urine trickles down the exterior of the toilet bowl. All of this leads to an unhygenic situation and the generation of an unpleasant odour around the toilet bowl. In order to maintain proper hygienic levels, the rim and exterior of the toilet bowl must be cleaned regularly. This is a distasteful task for many people.

The following patents disclose devices relating to protection of toilets, and other articles.

| U.S. Pat. No. | Inventor | Issue Date |
|---|---|---|
| 1,641,029 | Gaudet | August 30, 1927 |
| 2,825,070 | Alexander et al. | March 4, 1958 |
| 2,658,201 | Sherwood | November 10, 1953 |
| 3,524,203 | Ruggles | August 18, 1970 |
| 3,914,803 | Gregovski | October 28, 1975 |
| 4,160,295 | Putyra | July 10, 1979 |
| 4,285,075 | Nelson | August 25, 1981 |
| 4,720,880 | Barreau | January 26, 1988 |

Ruggles teaches a surround or shroud covering for enclosing conventional bathroom toilets. The shroud extends upwardly from a floor covering. The floor covering covers the floor area of the bathroom. The edge of the floor covering curves upwardly under the overhang of a bathtub enclosure or sink enclosure. A backwall conceals a water tank. The shroud has an upper edge which surrounds the undersides of a toilet. The toilet rim is fitted with an adapter ring, the adapter ring having downwardly extending flanges which are secured to the upper edges of shroud. The adapter ring sits on the toilet ring and may be caulked into place using conventional caulking methods.

Ruggles does not contemplate a disposable device and, further, does not contemplate using the device to provide increased hygiene. The upper edge of the shroud is affixed to the rim of the toilet using an adapter ring, rather than clips.

The Putyra patent discloses a fabric, or other flexible material, which is hung as a shroud around a toilet bowl. The shroud is attached to the toilet bowl rim by means of releasable hooks which hook over the toilet bowl rim and are adapted to support the upper edge of the shroud. The shroud material may be removed for cleaning.

Putyra describes a decorative arrangement and does not contemplate using the shroud for hygienic purposes. Further, the Putyra toilet shroud does not cover the toilet bowl rim and consequently would not protect against urine and overspray which collect on the toilet bowl rim and run down the outside of the toilet bowl.

Sherwood teaches a rigid casing for covering or protecting toilet bowls so that cleaning the under surfaces of the toilet bowl is not required. The casing is comprised of two complementary parts which fit snugly around the toilet bowl rim and which fit together so as to provide a front wall and side walls.

Gaudet and Nelson each disclose a floor mat for use in front of a toilet bowl to prevent the floor from becoming wet. Both the Gaudet and Nelson mat are contoured so as to fit snugly around the base of the toilet bowl. Nelson, provides a mat having a porous grid upper surface covering and an absorbent disposable liner for absorbing urine falling on the mat.

Gregovski provides a splash shield which is affixed to the underside of a conventional toilet seat. When the toilet seat is raised the splash shield is also raised so that the shield extends along either side of the toilet bowl. The shield extends between the raised toilet seat and the toilet bowl rim so as to form splash guards around the toilet bowl.

Barreau teaches a disposable protective lining for use on a toilet seat. The lining provides a barrier between the user and toilet. Alexander teaches a toilet seat insert which allows small children to sit on a conventional toilet seat.

SUMMARY OF THE INVENTION

The subject invention is directed to a toilet bowl skirt which comprises a light flexible plastic sheet which is releasably secured around the rim of a conventional toilet bowl. Plastic clips and hook and pile fasteners (VELCRO TM) are utilized to secure the plastic sheet to the rim of the toilet bowl. The plastic sheet acts as a shroud around the toilet bowl and extends outwardly from the base of the toilet to form a water impervious floor mat. The edges of the sheet are raised so as to contain stray fluid which falls onto the sheet. The toilet guard keeps urine off the back hinges of the toilet seat, the rim under the toilet seat, the ceramic surfaces of the toilet and the floor adjacent to the base of the toilet. The toilet guard is easily detachable so as to be washable or disposable.

A removable toilet bowl protector which comprises in combination a flexible waterproof sheet which is adapted to cover the exterior surfaces of a toilet bowl and the toilet seat hinges. The protector has a hole in the central area thereof, the periphery around the hole being adapted to fit about the upper rim and partially into the interior of a toilet bowl. Attachment means are used to enable the periphery around the hole to be releasably attached to the upper rim of the toilet bowl.

A protector as described wherein the sheet has a bead around the exterior circumference of the sheet, the bead being adapted to rest on the floor surrounding the toilet bowl. In the protector, the periphery around the hole of the sheet can be elasticized to enhance the fitting of the periphery to the upper rim of the toilet bowl. The upper rim attachment means can be a plurality of clips, or hook and pile fasteners (VELCRO).

A protector as described wherein the protector includes a drawstring which is adapted to secure the mid-region of the sheet about the waist of the toilet bowl and or VELCRO fasteners holding together the rear region of the sheet against the back of the toilet bowl. The periphery around the central hole can be creped, or made of stretchable material.

The protector can be made of washable rubber backed cloth, flexible disposable biodegradable plastic or hand washable flexible plastic, such as vinyl or polyethylene.

BRIEF DESCRIPTION OF THE DRAWINGS

In drawings which illustrate specific embodiments of the invention, but which should not be construed as restricting the spirit or scope of the invention in any way.

DETAILED DESCRIPTION OF A PREFERRED EMBODIMENT OF THE INVENTION

The subject invention is an easily used washable, reusable, retainable or disposable accessory for toilet bowls. The invention comprises a light flexible plastic sheet which is releasably secured around the rim of a toilet bowl and the hinges of the toilet seat. The invention acts as a protective skirt so that overspray from male persons who urinate into the toilet bowl from a standing position is contained on the plastic skirt and is kept off the bottom back hinging area of the toilet seat and the ceramic surfaces of the toilet. The entire skirt is easily detachable and is disposable or washable for re-use. The invention is intended to provide increased hygiene in hospitals and other public facilities, as well as a decorative touch in the home.

Figure 1:
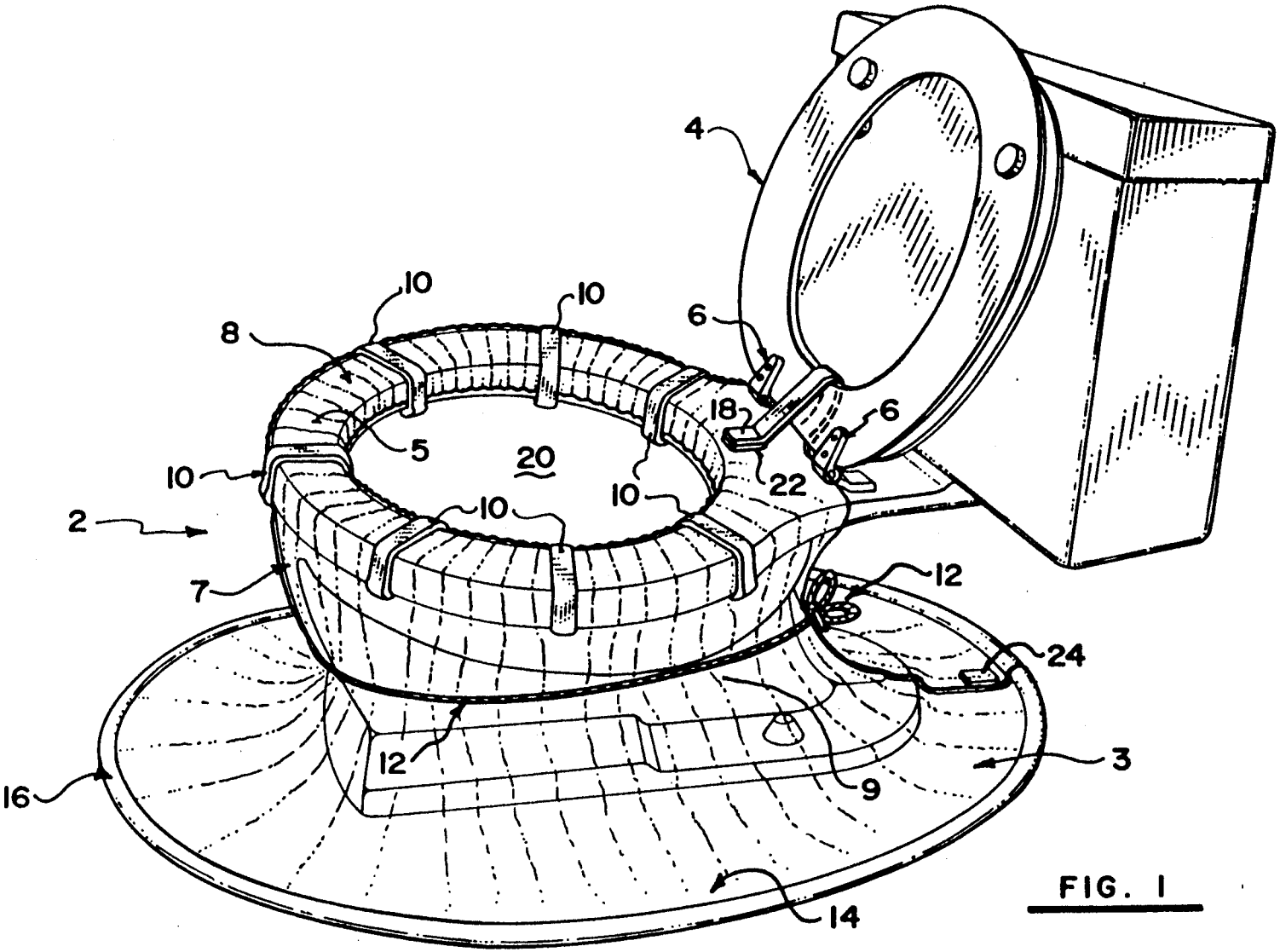
FIG. 1 illustrates a perspective view of the toilet bowl protector installed on a toilet.

Referring to FIG. 1, which illustrates a perspective view of the toilet bowl protector 2, it can be seen that the protector 2 is constructed of flexible waterproof sheeting 3 which can be fitted over the rim 5 and around the bowl 7 of a conventional toilet. The protector 2 fits underneath the toilet seat 4 except at the back where a tab 18 fastened by releasable fasteners 22 (see FIG. 2) is looped around the rear area of the toilet seat 4. The tab 18 shields the hinges 6 of the toilet seat from overspray. By fitting under the toilet seat 4, except for over the hinges 6, the protector 2 does not prevent the toilet seat 4 from being lifted upwardly about hinge 6. The protector 2 has an opening 20 therein and an upper toilet bowl rim conforming section 8, which can be secured around the rim 5 of the toilet bowl. The rim conforming section 8 also extends partially into the interior of the toilet bowl. The section 8 can be secured to the toilet bowl rim 5 by a series of plastic clips 10 (see FIG. 3). The rim conforming section 8 can be creped or pleated so as to be stretchable and be able to fit various diameters of toilet bowl rims.

The protector sheet 2 fits around the circumference of the exterior of the toilet bowl and can be snugly secured in place about the waist 9 of bowl 7 by a drawstring 12. The ends of the drawstring 12 can be tied together with a conventional shoelace bow 13. The bottom region 14, of the protector lays on the floor area surrounding the toilet bowl 7. The bottom region 14 has around its circumference a bead rim 16, which causes the edges of the floor region 14 to hug the bottom by preventing the edges of the bottom region 14 from wrinkling. This creates an impervious liquid containing area around the toilet bowl 7.

Figure 2:
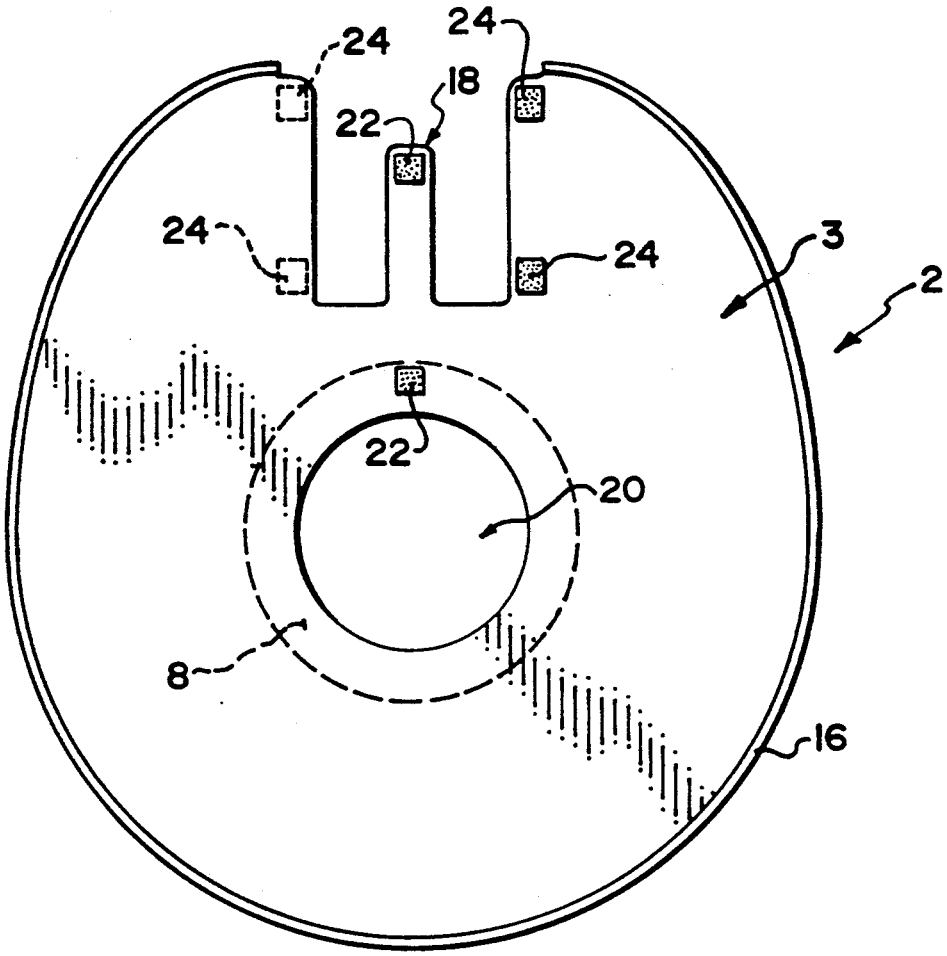
FIG. 2 illustrates a top view of the toilet bowl protector spread out flat.

FIG. 2 illustrates a top view of the protector 2, spread out to show its construction. The protector 2, which can be constructed of flexible plastic, such as polyvinyl or polyethylene, washable or disposable, and biodegradable, or of a rubber backed fabric, has a generally circular shape. A circular opening 20 is formed in the centre. The protector rim 8, which can be creped or elasticized, surrounds the opening 20. A rim 16, which is optional, is formed around the exterior of protector 2. At the rear of the protector, a tab 18 is formed, with a pressure fastener such as a hook and pile (VELCRO) fastener 22 positioned at the end of the tab 18. Other fasteners 24 are located at the other rear areas of the protector 2. When the protector 2 is installed on the toilet, the tab 18 is looped around the rear of the toilet seat 4 and fastened with fasteners 22. Fasteners 24 are used to fasten the protector around the back of the hinge 6 and the rear of the toilet bowl.

Figure 3:
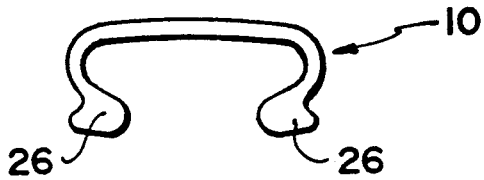
FIG. 3 illustrates a side view of clips used to fasten the protector to the toilet bowl rim.

FIG. 3 illustrates a hook or clip 10 which can be used to fasten the protector rim 8 to the toilet bowl rim 5 and partially inside the toilet bowl. Clips 10 can be formed of resilient plastic which exerts a gripping force on gripping feet 26 which are adapted to fit under the inside and outside edges of a toilet bowl rim 5.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The embodiments of the invention in which an exclusive property or privilege is claimed are defined as follows:

1. A removable toilet bowl protector for use with a toilet bowl having an upper rim, a waist portion and a base portion, said protector comprising:
   (a) a flexible waterproof sheet which is adapted to cover the exterior surfaces of a toilet bowl and which sheet has a hole in the central area thereof, a portion of the sheet around the hole being adapted to fit about an upper rim of the toilet bowl;
   (b) attachment means for enabling the portion around the hole to be releasably attached to the upper rim of the toilet bowl;
   (c) a bead around at least a portion of the exterior circumference of the sheet, the bead being adapted to rest on a floor surrounding the base portion of the toilet bowl;
   (d) an intermediate portion adapted to fit around the waist portion of said bowl;
   (e) wherein with said portion around the hole attached to the rim and said intermediate portion fitting around the waist portion, said bead will extend completely around the base portion of the bowl.

2. A protector as claimed in claim 1 wherein the periphery around the hole of the sheet is elasticized to enhance the fitting of the periphery to the upper rim of the toilet bowl.

3. A protector as claimed in claim 1 wherein the upper rim attachment means is a plurality of clips.

4. A protector as claimed in claim 1, 2 or 3 wherein a protector includes a drawstring which is adapted to secure the mid-region of the sheet about the waist of the toilet bowl.

5. A protector as claimed in claim 1, 2 or 3 wherein the periphery around the central hole is creped.

6. A protector as claimed in claim 1 wherein the protector has a tab formed in one side, and releasable fastening means on the tab and adjoining areas of the sheet, the tab and releasable fastening means being adapted to fit around the rear area of a toilet seat.

7. A protector as claimed in claim 6 wherein the protector has fastening means at the rear area adapted to enable the protector to be releasably secured around the rear of the toilet bowl.

* * * * *